United States Patent [19]

Cohen et al.

[11] Patent Number: 4,523,722

[45] Date of Patent: Jun. 18, 1985

[54] ADJUSTABLE DISPLAY APPARATUS

[75] Inventors: Melvin Cohen, Franklin Lake; Fred V. Duyne, Ringwood, both of N.J.

[73] Assignee: Melrose Displays, Inc., Passaic, N.J.

[21] Appl. No.: 490,237

[22] Filed: Apr. 29, 1983

[51] Int. Cl.[3] ..... A47F 5/00

[52] U.S. Cl. ..... 211/175; 211/134; 211/186; 211/189; 108/102

[58] Field of Search ..... 211/175, 186, 134, 187, 211/188, 189, 153; 108/102, 93, 43; 160/216, 221

[56] References Cited

U.S. PATENT DOCUMENTS

| | | | |
|---|---|---|---|
| 2,994,441 | 8/1961 | Browning, Jr. | 211/189 |
| 3,174,442 | 3/1965 | Marschak | 211/186 X |
| 3,276,400 | 10/1966 | Brunette | 211/187 X |
| 3,303,936 | 2/1967 | Barnawell | 211/134 |
| 3,389,882 | 6/1968 | Schlosser | 211/175 X |
| 3,765,344 | 10/1973 | Ferdinand et al. | 108/102 X |
| 3,883,004 | 5/1975 | Slaga | 211/175 X |
| 4,025,137 | 5/1977 | Wyler | 108/93 X |
| 4,036,369 | 7/1977 | Eisenberg | 108/102 X |
| 4,093,078 | 6/1978 | Radek | 211/189 |
| 4,267,931 | 5/1981 | Belotta | 211/153 |
| 4,319,688 | 3/1982 | Wahl | 211/175 |

*Primary Examiner*—William H. Schultz
*Assistant Examiner*—Blair M. Johnson
*Attorney, Agent, or Firm*—Lackenbach Siegel Marzullo Presta & Aronson

[57] ABSTRACT

Adjustable display apparatus comprising a pair of laterally spaced side supporting elements, each having an elongated front leg, an elongated rear leg, an upper section joined to the upper ends of the front and rear legs, and a lower section joined to the front and rear legs near the lower ends thereof. Elongated support bars are removably connected to the upper and lower sections of the supporting elements and are positioned near the rear legs of the supporting elements. A pair of support panels, such as aperture boards, are secured to the rear portions of the support bars to provide a mounting surface extending between the supporting elements. The support panels are overlapped at their inner ends and are removably connected together at their overlapped portions. Laterally adjustable display racks are removably mounted in vertically spaced relation on the support panels and are laterally adjusted to extend across the support panels from one supporting element to the other. Laterally adjustable connecting members extend from the lower portion of one supporting element to the other and are removably secured at their ends thereto. The length of the display apparatus can easily be adjusted without disassembling the display apparatus by merely changing the amount of overlap of the support panels and the lengths of the display racks and the connecting members.

13 Claims, 5 Drawing Figures

ADJUSTABLE DISPLAY APPARATUS

BACKGROUND OF THE INVENTION

The present invention relates to an adjustable display apparatus and, more particularly, to such an apparatus having one or more display racks that can be adjusted in length without requiring the disassembly of the display apparatus.

Heretofore, many different types of display apparatus have been utilized for the visual display of articles such as candy, chewing gum or the like. In most cases, the dispaly apparatus has comprised a plurality of vertically spaced, elongated display racks that are fixedly mounted on the apparatus so that they cannot be adjusted in length. Being fixed in size, such display apparatus could only be used in display areas of a comparable size. In other cases, where the display racks are adjustable in length, the construction of the apparatus is such that a considerable portion of the apparatus has to be disassembled before the lengths of the display racks can be changed. See, for example, U.S. Pat. No. 4,267,931.

Accordingly, it will be readily seen that a need has arisen for a display apparatus that is so constructed as to enable the display racks thereon to be easily adjusted in length without requiring any significant disassembly of the apparatus. The display apparatus of the present invention fulfills this need. Also, it is sturdy, simple in construction, inexpensive to manufacture and easy to assemble.

SUMMARY OF THE INVENTION

The adjustable display apparatus of the present invention comprises a pair of laterally spaced side supporting elements, each having an elongated front leg, an elongated rear leg, an upper section joined to the upper ends of the front and rear legs, and a lower section joined to the front and rear legs near the lower ends thereof. Elongated support bars are removably connected to the upper and lower sections of the supporting elements and are positioned near the rear legs of the supporting elements. A pair of support panels, such as aperture boards, are secured to the rear portions of the support bars to provide a mounting surface extending between the supporting elements. The support panels are overlapped at their inner ends and are removably connected together at their overlapped portions.

Laterally adjustable display racks are removably mounted in vertically spaced relation on the support panels and are laterally adjusted to extend across the support panels from one supporting element to the other. Laterally adjustable connecting members extend from the lower portion of one supporting element to the other and are removably secured at their ends thereto. The length of the display apparatus can easily be adjusted without disassembling the display apparatus by merely changing the amount of overlap of the support panels and the lengths of the display racks and the connecting members.

In a preferred embodiment, the supporting elements and the support bars are of tubular construction, the display racks are of telescoping construction, and the connecting members are of tubular, telescoping construction.

DESCRIPTION OF THE PREFERRED EMBODIMENTS

Figure 2:
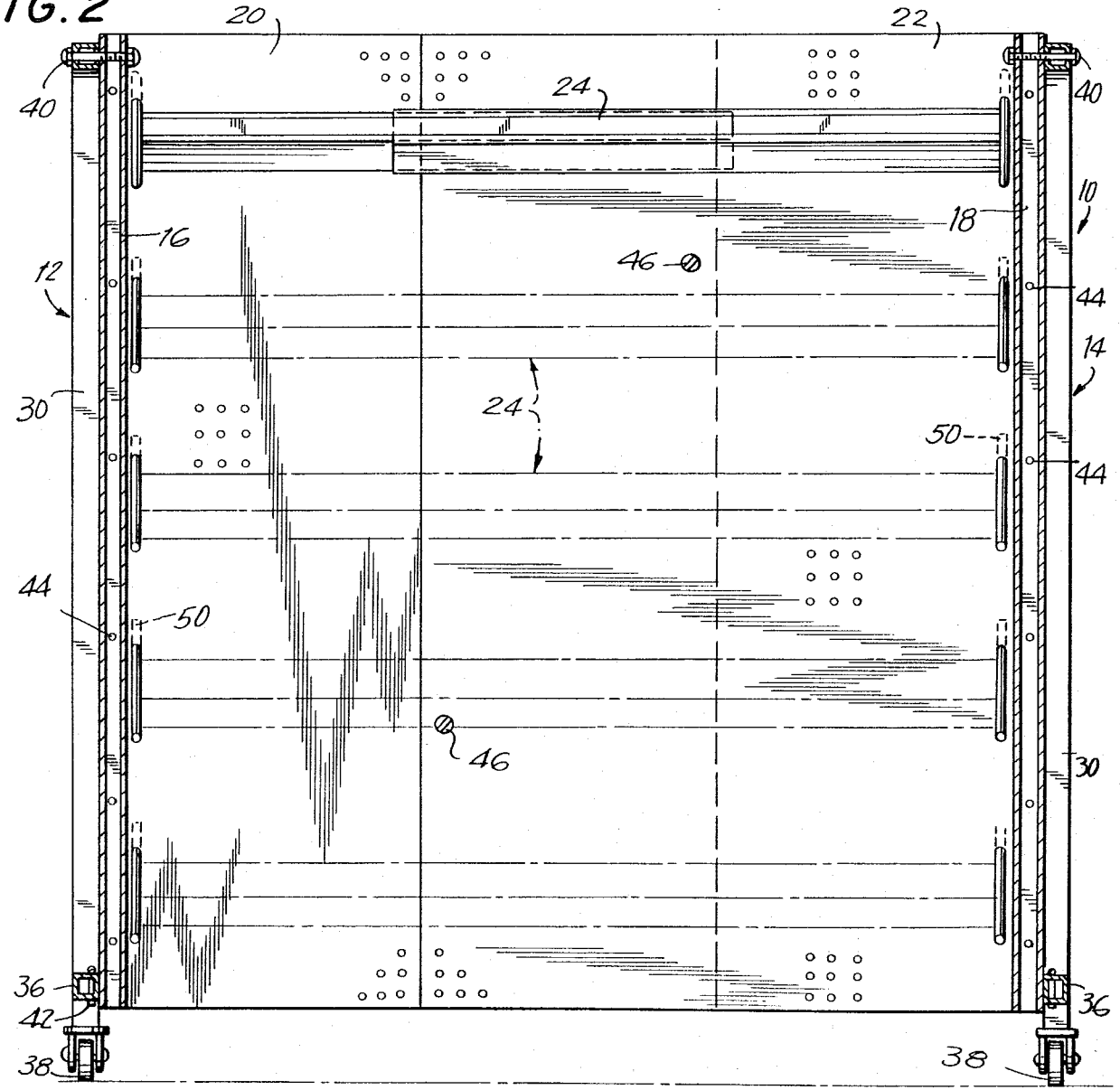
FIG. 2 is a sectional view taken substantially along line 2—2 in FIG. 1.
Figure 1:
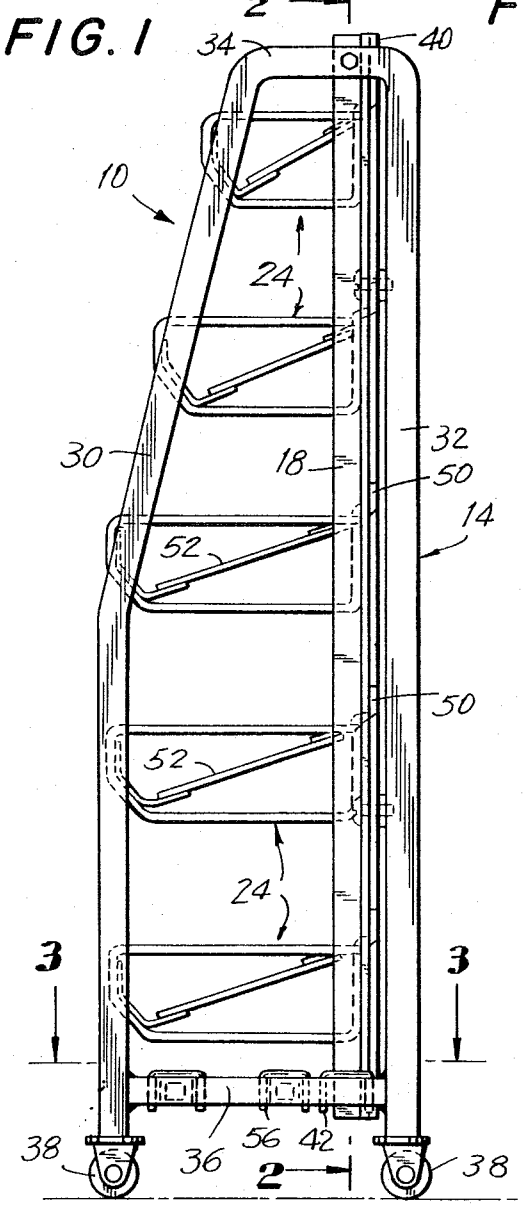
FIG. 1 is a side elevational view of the adjustable display apparatus of the present invention.
Figure 3:
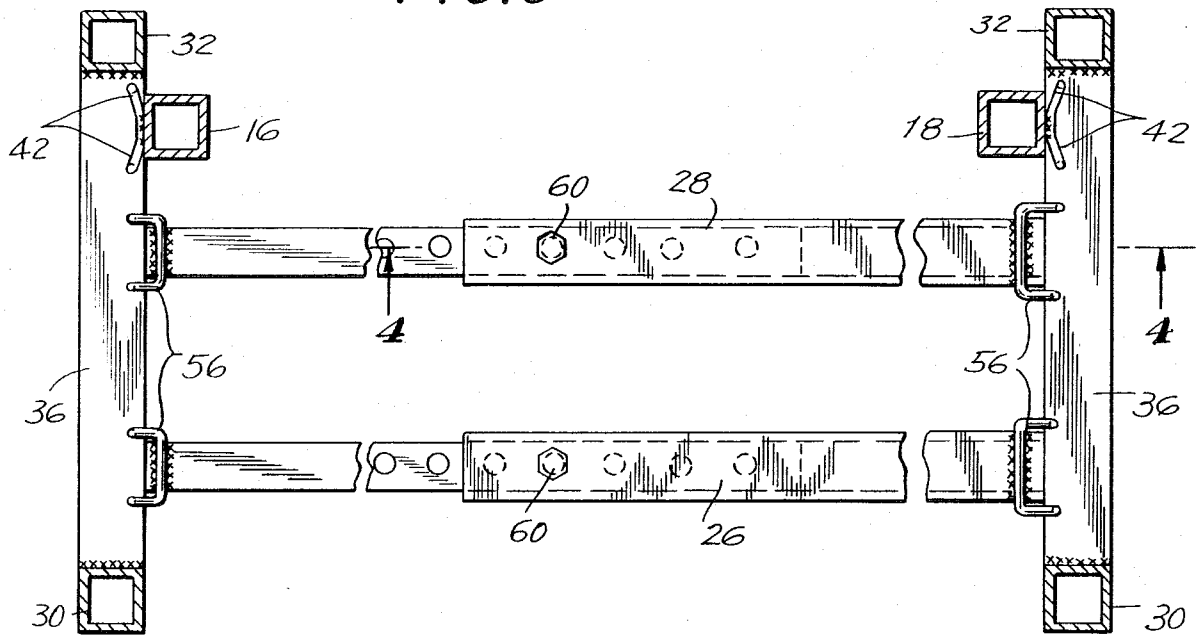
FIG. 3 is an enlarged sectional view taken substantially along line 3—3 in FIG. 1.

Referring to FIGS. 1–3, the adjustable display apparatus 10 of the present invention generally comprises a pair of upstanding side supporting elements 12, 14; a pair of upstanding support bars 16, 18 removably secured to the supporting elements 12, 14; a pair of support panels 20, 22 disposed in overlapping relation and removably secured to the support bars 16, 18 so as to extend laterally from one supporting element to the other; a plurality of laterally adjustable display racks 24 removably mounted in vertically spaced relation on the support panels 20, 22 and extending between the supporting elements 12, 14; and a pair of laterally adjustable connecting members 26, 28 extending from one supporting element to the other and being removably secured to the lower portions thereof.

As shown in FIG. 1, each supporting element 12, 14 preferably is of tubular construction and comprises an elongated front leg 30 that is tapered inwardly at its upper portion, an upstanding, elongated rear leg 32, an upper section 34 preferably connected to and formed integrally with the front leg 30 and rear leg 32, and a lower section 36 that is secured at its ends to the lower portions of the front leg 30 and rear leg 32. The lower ends of the front leg 30 and rear leg 32 preferably are provided with casters 38 or the like to facilitate the movement of the display apparatus to a desired position.

The upper section 34 of each supporting element 12, 14 is provided with an aperture extending laterally therethrough and the upper end of each support bar 16, 18 is provided with a corresponding aperture therethrough to enable the support bars to be removably connected at their upper ends to the supporting elements by nut and bolt connections 40 or the like. The lower end of each support bar 16, 18 is provided with downwardly extending fingers or rods 42 that are received within apertures in the upper surface of the lower sections 36 of the supporting elements 12, 14 to removably secure the support bars to the supporting elements at their lower ends. The support bars 16, 18 preferably are of tubular construction and are provided with a plurality of vertically spaced apertures 44 in their rear surfaces, as shown in FIG. 2.

A pair of apertured support panels 20, 22, such as aperture boards or the like, are removably secured at their outer ends to the rear surfaces of the support bars 16, 18 in any suitable manner, such as by screws (not shown) or the like received in the apertures 44. As shown in FIG. 2, the support panels preferably are of a height that is substantially the same as that of the support bars. Also, the support panels 20, 22 are overlapped at their inner end portions and are removably secured together at their overlapped portions by one or more nut and bolt connections 46 or any other suitable connecting means.

As illustrated in FIGS. 1 and 2, the plurality of laterally extending and adjustable display racks 24 are removably mounted on the support panels 20, 22 in vertically spaced relation by mounting fingers 50 or the like that extends rearwardly and upwardly from the ends of the display racks and extend through the adjacent apertures in the support panels 20, 22. The display racks 24 may be of any suitable, laterally adjustable construction. Preferably, the display racks are formed of wire or the like and are of telescoping construction so that their lengths can be varied by movement of the support panels 20, 22 on which they are mounted. Referring to FIG. 2, each display rack 24 preferably is provided with an inclined support surface 52 for the display of articles of any desired type, such as candy, chewing gum or the like. The depth of the display racks 24 can be varied to correspond generally with the depth of the adjacent portions of the supporting elements 12, 14, as shown in FIG. 1.

Figure 4:
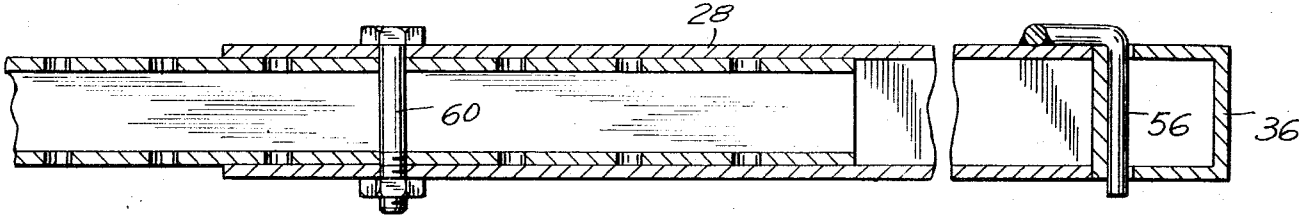
FIG. 4 is an enlarged sectional view taken substantially along line 4—4 in FIG. 3.

As shown in FIGS. 3 and 4, the pair of laterally adjustable connecting members 26, 28 extend laterally between the lower sections 36 of the supporting elements 12, 14 and are removably secured thereto by locking fingers 56 or the like that are received within corresponding apertures in the upper surfaces of the lower sections 36. Preferably, each connecting member 26, 28 is of telescoping construction and is provided with corresponding apertures in each telescoping section thereof which are adapted to receive a locking means, such as a nut and bolt connection 60, therethrough to releasably lock the telescoping sections of the connecting member in desired relative positions to vary the length thereof.

From the foregoing description, it will be readily seen that the lengths of the display racks 24 can be varied by merely adjusting the relative lateral positions of the supporting elements 12, 14. This is easily accomplished by releasing the nut and bolt connections 46 at the overlapped portions of the support panels 20, 22 and the nut and bolt connections 60 between the telescoping sections of the connecting members 26, 28. The supporting elements 12, 14 can then be moved laterally relative to each other to laterally move the telescoping sections of the display racks 24 until the desired length of the display racks is reached. During this movement, the support panels 20, 22 and the telescoping sections of the connecting members 26, 28 are also moved laterally relative to each other a distance corresponding to the change in length of the display racks. Accordingly, the lengths of the display racks 24 can be varied without requiring any disassembly of the components of the present display apparatus, other than the releasing of the connections 46 and 60.

The telescoping display rack which is shown in the drawing may be, if desired, suitably provided with means for holding pricing tags, such as the movable slidable lips of the aforementioned U.S. patent.

When the display racks 24 have been laterally adjusted to the desired positions, the connection 46 is again effected between the overlapped portions of the support panels 20, 22, and the connections 60 are again effected between the telescoping sections of the connecting members 26, 28 to releasably lock the display racks 24 in the desired positions.

Figure 5:
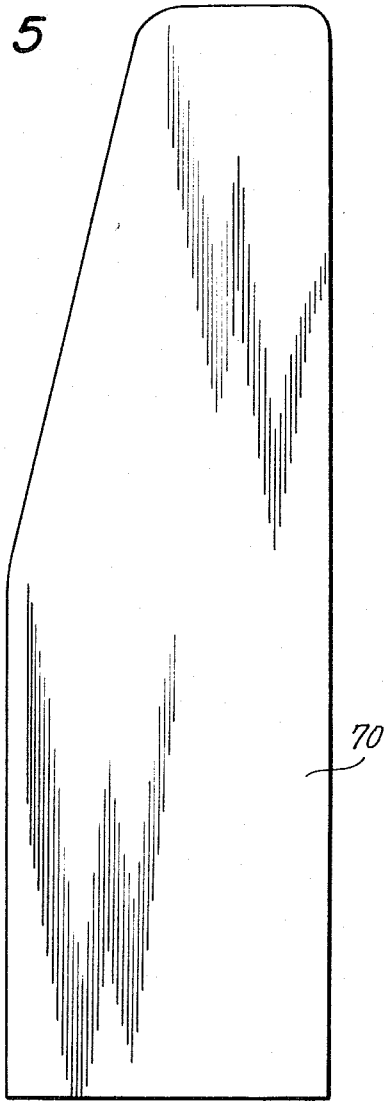
FIG. 5 is a side elevational view of a side panel which can be mounted on a supporting element of the display apparatus, in accordance with one embodiment of the present invention.

If desired, the outer sides of the supporting elements 12, 14 may comprise a side panel 70 (FIG. 5) mounted in any suitable manner.

Although the present invention has been described in some detail by way of illustration and example for purposes of clarity of understanding, it will, of course, be understood that various changes and modifications may be made in the form, details, and arrangements of the parts without departing from the scope of the invention as set forth in the following claims:

We claim:

1. Adjustable display apparatus comprising:

a pair of upstanding, laterally spaced supporting elements, a pair of upstanding support panels disposed in overlapping relation at juxtaposed end positions, means for removably mounting said support panels at their opposite end portions on said supporting elements, laterally adjustable means for removably connecting the lower end portions of said supporting elements, and a plurality of laterally adjustable display means disposed in overlapping telescoping relation at juxtaposed end positions and removably mounted on said support panels and extending laterally between said supporting elements, whereby said display apparatus and said display means may be simultaneously adjustable laterally by changing the spacing between upstanding supporting elements within the limits of the overlapping relationship of said support panels and said display means.

2. The adjustable display apparatus of claim 1 wherein each of said supporting elements comprises an elongated front leg, an elongated rear leg, an upper section joining said front and rear legs, and a lower section joining said front and rear legs.

3. The adjustable display apparatus of claim 1 wherein said means for removably mounting said support panels comprises elongated, upstanding support bars removably connected to said supporting elements, said support bars being releasably connected to said support panels.

4. The adjustable display apparatus of claim 2 wherein said means for removably mounting said support panels comprises elongated, upstanding support bars removably connected to said upper and lower sections of said supporting elements, said support bars being releasably connected to said support panels.

5. The adjustable display apparatus of claim 1 wherein said support panels have a plurality of apertures therethrough, and said display means comprise locking fingers that are receivable within said apertures to mount said display means on said support panels.

6. The adjustable display apparatus of claim 1 wherein said means for removably connecting the lower end portions of said supporting elements comprises telescoping sections, and means for releasably locking said telescoping sections together in desired relative positions.

7. The adjustable display apparatus of claim 6 wherein said display means comprises telescoping sections.

8. The adjustable display apparatus of claim 6 wherein said means for removably connecting the lower end portions of said supporting elements comprise a pair of connecting members extending laterally between said supporting elements and removably connected to the lower end portions thereof.

9. The adjustable display apparatus of claim 1 wherein a plurality of said display means are mounted in laterally extending, vertically spaced relation on said support panels.

10. The adjustable display apparatus of claim 1 wherein said supporting elements comprise side panels.

11. The adjustable display apparatus of claim 1, wherein said plurality of laterally adjustable display means are of different sizes relative to their projection outwardly from said support panels.

12. The adjustable display apparatus of claim 11, wherein said laterally adjustable display means of smaller sizes are disposed in descending size order from top to bottom of said display apparatus.

13. Adjustable display apparatus comprising:

a pair of upstanding, laterally spaced supporting elements each of which comprises an elongated front leg, an elongated rear leg, an upper section joining said front and rear legs, a lower section joining said front and rear legs;

a pair of upstanding support panels disposed in overlapping relation at their inner end positions and wherein said support panels have a plurality of apertures therethrough;

means for removably mounting said support panels at their outer end portions on said supporting elements which means comprises elongated, upstanding support bars removably connected to said supporting elements, said support bars being releasably connected to said support panels;

laterally adjustable means for removably connecting the lower end portions of said supporting elements which means comprises telescoping sections; and laterally adjustable display means comprising telescoping shelves having mounting fingers at opposite ends thereof removably mounted on said support panels and extending laterally between said supporting elements and wherein a plurality of said display means are mounted in laterally extending, vertically spaced relation on the supporting panels.

* * * * *